US011514837B2

(12) United States Patent
Kang

(10) Patent No.: US 11,514,837 B2
(45) Date of Patent: Nov. 29, 2022

(54) DISPLAY DEVICE AND DRIVING CIRCUIT

(71) Applicant: LG Display Co., Ltd., Seoul (KR)

(72) Inventor: JeongHo Kang, Gyeonggi-do (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/358,353

(22) Filed: Jun. 25, 2021

(65) Prior Publication Data

US 2022/0005401 A1 Jan. 6, 2022

(30) Foreign Application Priority Data

Jul. 2, 2020 (KR) ..... 10-2020-0081319

(51) Int. Cl.
*G09G 3/3275* (2016.01)
*G09G 3/20* (2006.01)

(52) U.S. Cl.
CPC ... *G09G 3/2092* (2013.01); *G09G 2310/0272* (2013.01); *G09G 2310/0291* (2013.01); *G09G 2310/08* (2013.01); *G09G 2330/12* (2013.01)

(58) Field of Classification Search
CPC ..... G09G 3/2092; G09G 2310/0272; G09G 2310/0291; G09G 2310/08; G09G 2330/12; G09G 3/3225; G09G 2330/04; G09G 3/20; G09G 3/006; G09G 3/3291; G09G 3/3685
See application file for complete search history.

(56) References Cited

U.S. PATENT DOCUMENTS

| | | | | |
|---|---|---|---|---|
| 6,937,178 | B1 * | 8/2005 | Rempfer | H03M 1/0678 341/154 |
| 2015/0229117 | A1 * | 8/2015 | Kim | H02H 3/08 345/212 |
| 2016/0247482 | A1 * | 8/2016 | Zeng | G09G 3/3685 |
| 2016/0322013 | A1 * | 11/2016 | Fukute | G09G 3/3648 |
| 2017/0194354 | A1 * | 7/2017 | Kim | H01L 27/1218 |
| 2017/0269398 | A1 * | 9/2017 | Park | H01L 27/0292 |
| 2018/0053466 | A1 * | 2/2018 | Zhang | H01L 27/3276 |
| 2018/0174505 | A1 * | 6/2018 | Mandlik | H01L 27/3276 |
| 2018/0350284 | A1 * | 12/2018 | Park | G09G 3/006 |
| 2019/0237014 | A1 * | 8/2019 | Leerentveld | G09G 3/3233 |
| 2020/0066196 | A1 * | 2/2020 | Hao | H01L 27/3223 |
| 2020/0090566 | A1 * | 3/2020 | Lee | G09G 3/035 |
| 2020/0111395 | A1 * | 4/2020 | Kang | G09G 3/3225 |
| 2020/0327834 | A1 * | 10/2020 | Kim | G09G 3/2074 |
| 2021/0090479 | A1 * | 3/2021 | Cheng | G09G 3/20 |
| 2021/0201736 | A1 * | 7/2021 | You | G09G 3/3233 |
| 2021/0272488 | A1 * | 9/2021 | Hwang | G09G 3/20 |

* cited by examiner

*Primary Examiner* — Jose R Soto Lopez
(74) *Attorney, Agent, or Firm* — Polsinelli PC

(57) ABSTRACT

A display device and a driving circuit enable to detect the crack for each display panel block by independently controlling each data driving circuit in case of multi data driving circuit and to provide a display device and a driving circuit enable to detect not only fine cracks but also disconnection by sequentially comparing a voltage of the display panel block with a reference voltage using a plurality of reference resistors.

19 Claims, 13 Drawing Sheets

FIG. 8

PCD_Out

| Rpanel | D<1> | D<2> | D<3> | D<4> | D<5> | D<6> | D<7> | D<8> | D<9> |
|---|---|---|---|---|---|---|---|---|---|
| less than 3K | 1 | 1 | 1 | 1 | 1 | 1 | 1 | 1 | 1 |
| 3K ~ 5K | 0 | 1 | 1 | 1 | 1 | 1 | 1 | 1 | 1 |
| 5K ~ 7K | 0 | 0 | 1 | 1 | 1 | 1 | 1 | 1 | 1 |
| 7K ~ 9K | 0 | 0 | 0 | 1 | 1 | 1 | 1 | 1 | 1 |
| 9K ~ 11K | 0 | 0 | 0 | 0 | 1 | 1 | 1 | 1 | 1 |
| 11K ~ 13K | 0 | 0 | 0 | 0 | 0 | 1 | 1 | 1 | 1 |
| 13K ~ 15K | 0 | 0 | 0 | 0 | 0 | 0 | 1 | 1 | 1 |
| 15K ~ 17K | 0 | 0 | 0 | 0 | 0 | 0 | 0 | 1 | 1 |
| 17K ~ 19K | 0 | 0 | 0 | 0 | 0 | 0 | 0 | 0 | 1 |
| more than 19K or disconnection | 0 | 0 | 0 | 0 | 0 | 0 | 0 | 0 | 0 |

DISPLAY DEVICE AND DRIVING CIRCUIT

CROSS-REFERENCE TO RELATED APPLICATION

This application claims priority from Korean Patent Application No. 10-2020-0081319, filed on Jul. 2, 2020, which is hereby incorporated by reference in its entirety.

BACKGROUND

Field of the Disclosure

The present disclosure relates to a display device and a driving circuit.

Description of the Background

With the development of multimedia, the importance of flat panel display devices is increasing. In response to this, flat panel display devices such as a liquid crystal display (LCD), a plasma display panel (PDP), and an organic light emitting display (OLED) are commercially available.

Among the flat panel display devices, the organic light emitting display device is widely used as a mobile display device such as a laptop or smartphone because it is capable of low voltage driving, thin, excellent viewing angle, and fast response speed.

An organic light emitting display device includes a display panel in which a plurality of pixels are arranged in a matrix form. The display panel receives scan signals from a gate driving circuit and data voltages from a data driving circuit to drive each of the pixels. Also, the display panel receives a plurality of power voltages from a power supply circuit.

In this case, when a crack occurs due to an impact applied to the display panel from the outside, the power lines of the display panel may be shorted or disconnected from each other. For example, a high-potential voltage line receiving a high-potential voltage from a power supply circuit and a low-potential voltage line receiving a low-potential voltage from the power supply circuit may be shorted to each other. When an overcurrent flows, a burnt phenomenon being disconnected the power line may occur due to the overcurrent.

SUMMARY

The present disclosure provides a display device and driving circuit able to detect a crack effectively by configuring a crack detecting circuit for detecting cracks of a display panel in a data driving circuit.

In addition, the present disclosure provides a display device and driving circuit enable to detect the crack for each display panel block by independently controlling each data driving circuit in case of multi data driving circuit.

Further, the present disclosure provides a display device and driving circuit enable to detect not only fine cracks but also disconnection by sequentially comparing a voltage of the display panel block with a reference voltage using a plurality of reference resistors.

According to an aspect, aspects may provide a display device including: a display panel in which a plurality of data lines and a plurality of subpixels are arranged and divided into a plurality of display panel blocks; a plurality of data driving circuits including a plurality of crack detecting circuits and supplying data voltages to the plurality of display panels through the plurality of data lines; and a timing controller controlling the plurality of data driving circuits; wherein the plurality of crack detecting circuits generate a crack detection signal for all or part of the plurality of display panel blocks according to an operation mode of the plurality of the data driving circuits.

According to an aspect, the crack detecting circuit includes: a mode selector for selecting the operation mode of the data driving circuit; an integrator for accumulating an output signal of the mode selector; a comparator for comparing an output signal of the integrator with a crack reference voltage; a clock generator for generating a clock signal; a comparison voltage control logic for determining a clock period between a start point of a master mode and a point when a voltage of the display panel block becomes more than the crack reference voltage by using the clock signal supplied from the clock generator; and a counter for generating the crack detection signal by counting a number of the clocks included in the clock period supplied from the comparison voltage control logic using the clock signal supplied from the clock generator.

According to an aspect, the mode selector includes: a plurality of switches connected in series to a driving voltage; and a plurality of reference resistors connected in parallel to the plurality of switches.

According to an aspect, the integrator includes: an amplifier in which the output signal of the mode selector is applied to an inverting input terminal and a base voltage is applied to a non-inverting input terminal; and a feedback switch and a feedback capacitor connected in parallel between the inverting input terminal and an output terminal of the amplifier.

According to an aspect, the comparator includes an amplifier in which an accumulated voltage supplied from the integrator is applied to an inverting input terminal, and the crack reference voltage is applied to the non-inverting input terminal.

According to an aspect, the crack detection signal includes: a first detecting data corresponding to a time when a reference voltage transmitted through the reference resistor reaches the crack reference voltage; and a second detecting data corresponding to a time when a voltage of the display panel block reaches the crack reference voltage.

According to an aspect, the crack detecting circuit includes: a mode selector for selecting the operation mode of the data driving circuit; a reference voltage setter for generating a reference voltage; a reference voltage control logic for controlling the reference voltage setter; and a crack ruler for generating the crack detection signal by comparing a voltage of the display panel block with the reference voltage.

According to an aspect, the mode selector includes a plurality of switches and resistors connected in series between a driving voltage and a base voltage.

According to an aspect, the reference voltage setter includes: a reference resistor group comprising a plurality of reference resistors connected in parallel to a driving voltage; a reference switch group comprising a plurality of reference switches connected individually to the plurality of reference resistors; and a base resistor connected between the reference switch group and a base voltage.

According to an aspect, the crack ruler includes a comparator which compares a voltage of the display panel block supplied from the mode selector with the reference voltage.

According to an aspect, the crack detection signal is comprised of n-bit digital signal generated from a comparison result of a voltage of the display panel block and a plurality of different reference voltages sequentially selected by the reference voltage setter.

According to an aspect, states of the plurality of display panel blocks are classified with a normal state, a crack state, or a disconnection state.

According to an aspect, the operation mode includes: a master mode for detecting a state of a display panel block by the crack detecting circuit; a slaver mode for bypassing the crack detection signal supplied from the data driving circuit operating as the master mode; and a reporter mode for disconnecting an electrical connection between the display panel block and the data driving circuit.

According to an aspect, in case of detecting states of the entire display panel blocks, one data driving circuit among the plurality of data driving circuits is operated as the master mode; and other data driving circuits are operated as the slaver mode.

According to an aspect, in case of detecting states of part of the display panel blocks, one data driving circuit among the plurality of data driving circuits is operated as the master mode; and other data driving circuits are operated as the reporter mode.

According to an aspect, the display device further comprising: a first signal line serially connecting the timing controller and the plurality of data driving circuits to transmit a LOCK signal for initializing the plurality of data driving circuits and the crack detection signal; and a plurality of second signal lines transmitting digital image data by connecting the timing controller to the plurality of data driving circuits with 1:1.

According to an aspect, the crack detection signal is supplied to the timing controller through the LOCK signal line during a reporting period.

According to another aspect, aspects may provide a driving circuit of a display device supplying data voltage to a display panel in which a plurality of subpixels are arranged and divided into a plurality of display panel blocks comprising: a plurality of data driving circuits individually supplying the data voltage to each of the plurality of display panel blocks; wherein each of the plurality of data driving circuits include a crack detecting circuit for detecting states of all or part of the plurality of the display panel blocks according to an operation mode.

In the display device and driving circuit according to exemplary aspects, it may provide a display device and driving circuit enable to detect a crack effectively by configuring a crack detecting circuit for detecting cracks of a display panel in a data driving circuit.

In the display device and driving circuit according to exemplary aspects, it may provide a display device and driving circuit enable to detect the crack for each display panel block by independently controlling each data driving circuit in case of multi data driving circuit.

In the display device and driving circuit according to exemplary aspects, it may provide a display device and driving circuit enable to detect not only fine cracks but also disconnection by sequentially comparing a voltage of the display panel block with a reference voltage using a plurality of reference resistors.

DESCRIPTION OF DRAWINGS

The above and other features, and advantages of the present disclosure will be more clearly understood from the following detailed description, taken in conjunction with the accompanying drawings, in which:

FIG. 8 is a diagram illustrating a crack detection signal generated by the signal waveform of FIG. 7 in a display device according to other aspects;

DETAILED DESCRIPTION

Figure 1:
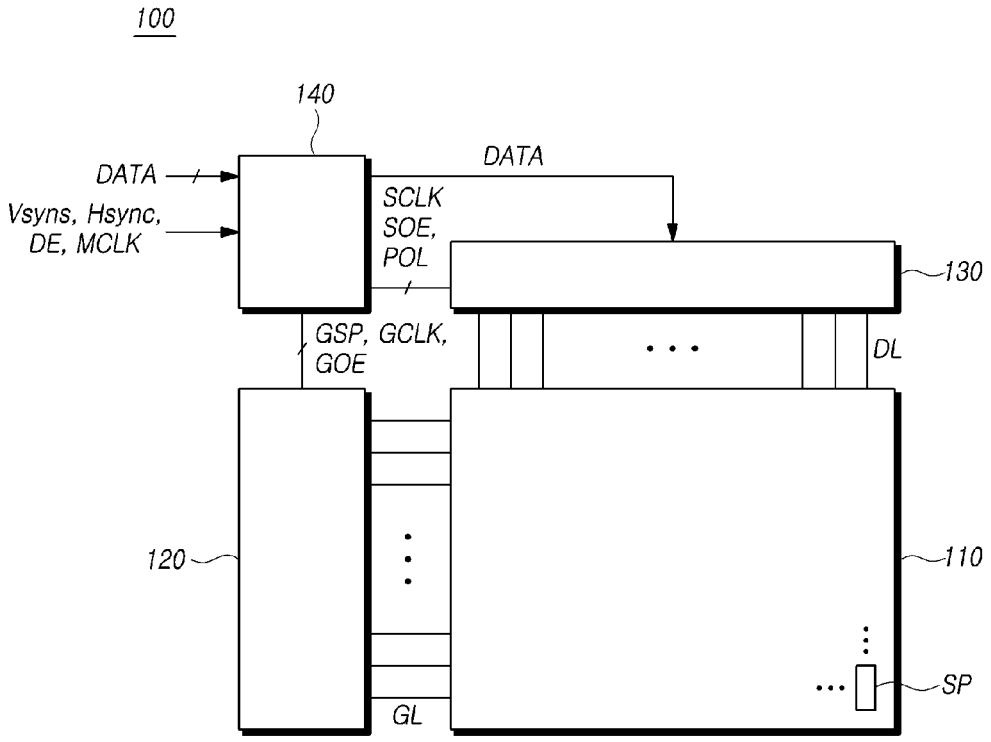
FIG. 1 is a block diagram illustrating a display device according to aspects.

In the following description of examples or aspects of the present disclosure, reference will be made to the accompanying drawings in which it is shown by way of illustration specific examples or aspects that can be implemented, and in which the same reference numerals and signs can be used to designate the same or like components even when they are shown in different accompanying drawings from one another. Further, in the following description of examples or aspects of the present disclosure, detailed descriptions of well-known functions and components incorporated herein will be omitted when it is determined that the description may make the subject matter in some aspects of the present disclosure rather unclear. The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" may be used herein to describe elements of the present disclosure. Each of these terms is not used to define essence, order, sequence, or number of elements etc., but is used merely to distinguish the corresponding element from other elements.

When it is mentioned that a first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element may be included in at least one of two or more elements that "are connected or coupled to", "contact or overlap", etc. each other.

When time relative terms, such as "after", "subsequent to", "next", "before", and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompass all the meanings of the term "can".

FIG. 1 is a block diagram illustrating a display device according to aspects.

Referring to FIG. 1, a display device 100 according to aspects includes a display panel 110, a gate driving circuit 120, a data driving circuit 130, and a timing controller 140.

The display panel 110 displays an image on the basis of a scan signal which is transmitted from the gate driving circuit 120 via a plurality of gate lines GL and a data voltage which is transmitted from the data driving circuit 130 via a plurality of data lines DL.

In the case of liquid crystal display (LCD), the display panel 110 includes a liquid crystal layer which is formed between two substrates and can operate in any known mode such as a twisted nematic (TN) mode, a vertical alignment (VA) mode, an in-plane switching (IPS) mode, or a fringe field switching (FFS) mode. On the other hand, in the case of an organic light emitting display (OLED), the display panel 110 may be implemented in a top emission method, a bottom emission method, or a dual emission method.

The display panel 110 may include a plurality of pixels arranged in a matrix form, and each pixel consists of a plurality of subpixels SP with a different color, for example, a white subpixel, a red subpixel, a green subpixel, and a blue subpixel. The plurality of subpixels SP constituting the display panel 110 are defined by the plurality of data lines DL and the plurality of gate lines GL. Each subpixel SP includes a thin film transistor TFT that is formed in an area in which one data line DL and one gate line GL intersect each other, a light emitting element such as an organic light emitting diode (OLED) that is charged with a data voltage, and a storage capacitor that is electrically connected to the light emitting element and maintains a voltage.

For example, a display device 100 with a resolution of 2,160×3,840 consisting of 4 subpixels SP of a white subpixel (W), a red subpixel (R), a green subpixel (G), and a blue subpixel (B) includes 2,160 gate lines GL and 3,840×4=15,360 data lines DL for 3,840 pixels consisting of 4 subpixels (WRGB). Each subpixel SP is arranged at points at which the gate lines GL and the data lines DL intersect each other.

The timing controller 140 controls the gate driving circuit 120 and the data driving circuit 130. The timing controller 140 receives digital image data DATA and timing signals such as a vertical synchronization signal Vsync, a horizontal synchronization signal Hsync, a data enable signal DE, and a main clock MCLK from a host system (not illustrated in the drawing).

The timing controller 140 controls the gate driving circuit 120 on the basis of scan timing control signals such as a gate start pulse GSP, a gate clock signal GCLK, and a gate output enable signal GOE. The timing controller 140 controls the data driving circuit 130 on the basis of data timing control signals such as a source sampling clock signal SCLK, a polarity control signal POL, and a source output enable signal SOE.

The gate driving circuit 120 sequentially drives the plurality of gate lines GL by sequentially supplying a plurality of scan signals to the display panel 110 via the plurality of gate lines GL. Here, the gate driving circuit 120 is also referred to as a scan driving circuit or a gate driving integrated circuit (GDIC).

The gate driving circuit 120 includes one or more gate driving integrated circuits (GDIC) and may be disposed on only one side or on both sides of the display panel 110 depending on a driving mode. Alternatively, the gate driving circuit 120 may be incorporated into a bezel area of the display panel 110 and embodied in the form of a gate in panel (GIP).

The gate driving circuit 120 sequentially supplies a plurality of scan signals of an ON voltage or an OFF voltage to a plurality of gate lines GL under the control of the timing controller 140. For this purpose, the gate driving circuit 120 may include a shift register or a level shifter.

The data driving circuit 130 receives digital image data DATA from the timing controller 140 and drives the plurality of data lines DL by converting the digital image data DATA to an analog data voltage and supplying the analog data voltage to the plurality of data lines DL. Here, the data driving circuit 130 is also referred to as a source driving circuit or a source driving integrated circuit (SDIC).

The data driving circuit 130 includes one or more source driving integrated circuits (SDIC). The source driving integrated circuit may be connected to bonding pads of the display panel 110 in a tape automated bonding (TAB) manner or a chip on glass (COG) manner or may be disposed directly on the display panel 110. In some cases, each source driving integrated circuit (SDIC) may be integrated and disposed on the display panel 110. Each source driving integrated circuit (SDIC) is embodied in a chip on film (COF) manner. In this case, each source driving integrated circuit (SDIC) is mounted on a flexible circuit film and is electrically connected to the data lines DL of the display panel 110 via the flexible circuit film.

When a specific gate line GL is turned on by the gate driving circuit 120, the data driving circuit 130 converts digital image data DATA received from the timing controller 140 to an analog data voltage type and supplies the analog data voltage to the plurality of data lines DL.

The data driving circuit 130 may be disposed in only one of an upper part and a lower part of the display panel 110, or may be disposed in both the upper part and the lower part of the display panel 110 depending on a driving mode or a design specification.

The data driving circuit 130 includes a shift register, a latch circuit, a digital-analog converter DAC, and an output buffer. Here, the digital-analog converter DAC is an element that converts the digital image data DATA received from the timing controller 140 to an analog data voltage to supply the analog data voltage to the plurality of data lines DL.

On the other hand, the display device 100 further includes a memory. The memory may temporarily store digital image data DATA received from the timing controller 140 and supply the digital image data DATA to the data driving circuit 130 at a predetermined time.

The memory may be disposed inside or outside the data driving circuit 130. When the memory is disposed outside the data driving circuit 130, the memory may be disposed between the timing controller 140 and the data driving circuit 130. The memory further includes a buffer memory that stores the digital image data DATA received from the outside and supplies the digital image data DATA to the timing controller 140.

In addition, the display device 100 may include an interface for input, output, or communication of signals with another external electronic device or an electronic component. The interface may include, for example, one or more of a low-voltage differential signaling (LVDS) interface, a mobile industry processor interface (MIPI), and a serial interface.

Examples of the display device 100 may include a liquid crystal display device, an organic light emitting display device, and a plasma display panel.

Figure 2:
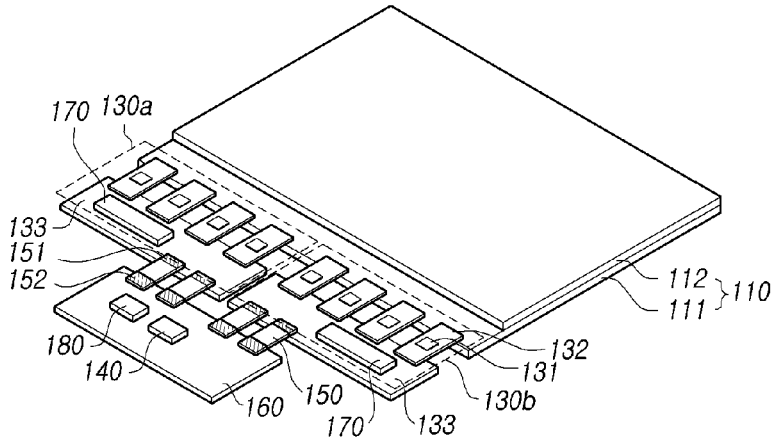
FIG. 2 is a perspective view illustrating a display device according to aspects.

FIG. 2 is a perspective view illustrating a display device according to aspects. Referring to FIG. 2, the display panel 110 of the display device 100 according to aspects may include a first substrate 111 and a second substrate 112. The first substrate 111 may be formed of a glass substrate or a plastic film, and the second substrate 112 may be formed of a glass substrate, a plastic film, an encapsulation film, or a barrier film.

The data driving circuit 130 may include one or more data driving circuits 130*a*, 130*b*, and each data driving circuit 130*a*, 130*b* may include at least one source driving integrated circuit (SDIC) 131 and crack detecting circuit 170. Here, it is illustrated a case where four source driving integrated circuits 131 and a crack detecting circuit 170 are included in the data driving circuits 130*a*, 130*b* as an example. But a number of the source driving integrated circuit 131 and the crack detecting circuit 170 is not limited thereto and may be variously changed.

In this case, the source driving integrated circuit 131 may be mounted on the flexible circuit film 132, and the flexible circuit film 132 may be a tape carrier package or chip on film that can be bent or flexible.

The flexible circuit film 132 may be attached to the lower substrate 111 and the source printed circuit board 133 of the display panel 110. The flexible circuit film 132 may be attached to the lower substrate 111 by a tape automated bonding (TAB) using an anisotropic conductive film, whereby the source driving integrated circuit 131 may be connected to the plurality of data lines DL.

The source printed circuit board 133 may be a flexible printed circuit board or a printed circuit board, and may be connected to the flexible cable 150 through the first connector 151.

The crack detecting circuit 170 may be disposed on the source printed circuit board 133 or the flexible circuit film 132. Here, it is illustrated a case where the crack detecting circuit 170 is disposed on the source printed circuit board 133 as an example.

The crack detecting circuit 170 is configured in order to detect cracks such as fine cracks or disconnection generated in the display panel 110. Here, the crack may illustrate a case where the display panel 110 is divided by an external impact, a fracture or disconnection occurred in the signal line formed on the display panel 110. The crack also may include all of the phenomena that the display panel 110 is broken or scratched.

The control printed circuit board 160 may be connected to the flexible cable 150 through the second connector 152. Accordingly, the source printed circuit board 133 and the control printed circuit board 160 may be connected to the plurality of flexible cables 150 through one or more first connectors 151 and one or more second connectors 152.

The timing controller 140 and the power management integrated circuit (PMIC) 180 may be mounted on the control printed circuit board 160. In the case, the timing controller 140 and the power management integrated circuit 180 may be formed in a chip. The control printed circuit board 160 may be a flexible printed circuit board or a printed circuit board.

The power management integrated circuit 180 generates a reference voltage Vref from a main power applied from the main power supply, and supplies the reference voltage Vref to the source driving integrated circuit 131 of the data driving circuit 130. Also, the power management integrated circuit 180 may generate a high-potential voltage and a low-potential voltage from the main power, and supply them to the display panel 110. In addition, the power management integrated circuit 180 may supply driving voltages to the data driving circuit 130 and the gate driving circuit 120.

Figure 3:
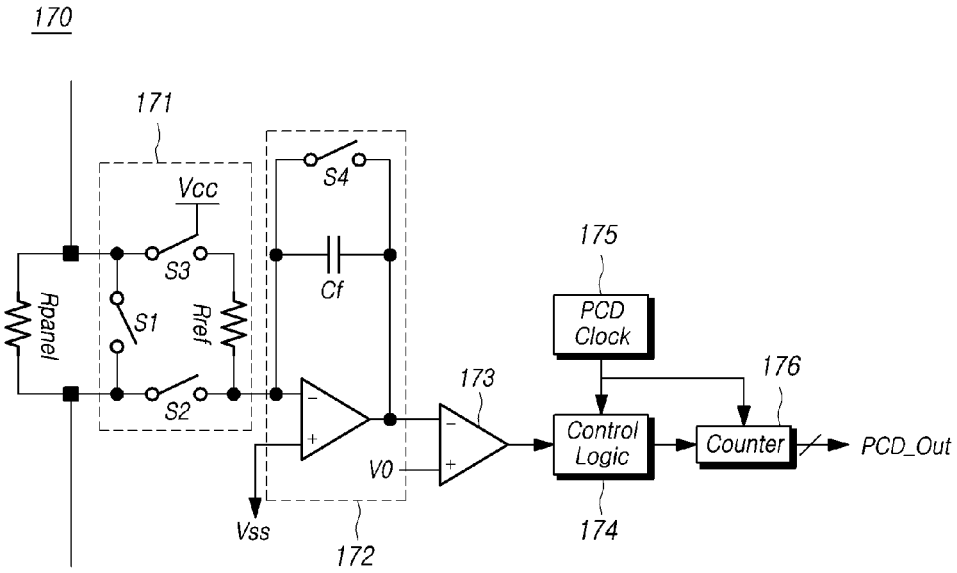
FIG. 3 is a circuit diagram illustrating a crack detecting circuit in a display device according to aspects.

FIG. 3 is a circuit diagram illustrating a crack detecting circuit in a display device according to aspects. The display device 100 according to aspects may include at least one data driving circuit 130, and a crack detecting circuit 170 may be included in each data driving circuit 130.

When the display device 100 is composed of a plurality of data driving circuits 130, the display panel 110 may be divided into a plurality of display panel blocks, and the data driving circuit 130 may be disposed on each display panel block. Thus, a data voltage may be supplied to each display panel block connected through each data driving circuit 130.

As described above, when the data driving circuit 130 including the crack detecting circuit 170 is configured in plural, each data driving circuit 130 may operate as a master mode, a slaver mode, or a reporter mode according to a control of the timing controller 140.

When the data driving circuit 130 operates as the master mode, it performs a crack detecting operation for detecting a crack state of a display panel block connected to the data driving circuit 130.

When the data driving circuit 130 operates as the slaver mode, it performs an operation of bypassing the crack detecting data supplied from the data driving circuit 130 operated as the master mode through an electrically connected LOCK signal line.

When the data driving circuit 130 operates as the reporter mode, it performs an operation of limiting the crack detection for the corresponding display panel block by disconnecting an electrical connection with display panel block connected to the data driving circuit 130.

In this way, by controlling the plurality of data driving circuits 130 as a master mode, a slaver mode, and a reporter mode, an operation of crack detection for all or part of the display panel blocks of the display panel 110 may be selectively performed.

For this operation, the crack detecting circuit 170 may include a mode selector 171, an integrator 172, a comparator 173, a comparison voltage control logic 174, a clock generator 175, and a counter 176.

The mode selector 171 may include a plurality of switches S1, S2, S3 connected in series to a driving voltage Vcc, and a reference resistor Rref connected in parallel to the plurality of switches S1, S2, S3. The reference resistor Rref is a resistor for comparison with a resistance Rpanel of the display panel block, and may have a value between 1 KΩ and 100 KΩ.

The plurality of switches S1, S2, S3 may be changed states of ON or OFF according to a master mode, a slaver mode, and a reporter mode of the data driving circuit 130, and both ends of the first switch S1 are connected to the display panel block through a crack detecting line to measure the voltage Vpanel of the display panel block.

In the case of the master mode capable of measuring the voltage Vpanel of the display panel block, the first switch S1 connected to the both ends of the display panel block is turned off, and the second switch S2 and the third switch S3 connected to the both ends are turned on, and the voltage Vpanel of the display panel block is supplied to the crack detecting circuit 170. In the master mode for measuring the voltage Vpanel of the display panel block, the means that the third switch S3 is turned on is implied that the third switch S3 is connected to the driving voltage Vcc to supply the driving voltage Vcc to the display panel block.

On the other hand, in the case of the slaver mode, the first switch S1 connected at both ends of the display panel block is turned on, and the third switch S3 and the second switch S2 are turned off.

At this time, since the both ends of the first switch S1 are respectively connected to an adjacent data driving circuit 130 at the previous stage and an adjacent data driving circuit 130 at the next stage, the crack detection signal PCD_Out supplied from the data driving circuit 130 at the previous stage is bypassed to the data driving circuit 130 at the next stage by the first switch S1 being turned on.

At the reporter mode, all of the first switch S1, the second switch S2, and the third switch S3 constituting the mode selector 171 are turned off. Accordingly, the crack detection signal PCD_Out supplied from the data driving circuit 130 at the previous stage is not transmitted to the data driving circuit 130 at the next stage.

The integrator 172 may include an amplifier in which a voltage supplied from the mode selector 171 is applied to an inverting input terminal (−) and a base voltage Vss is applied to a non-inverting input terminal (+), a fourth switch S4 and a feedback capacitor Cf connected in parallel between the inverting input terminal (−) and an output terminal of the amplifier. The fourth switch S4 may be referred to as a feedback switch.

The fourth switch S4 may be turned on when the feedback capacitor Cf constituting the integrator 172 is initialized.

Accordingly, the integrator 172 sequentially accumulates the voltage supplied through the mode selector 171 in the feedback capacitor Cf during the period in which the fourth switch S4 is turned off.

The comparator 173 receives the accumulated voltage supplied from the integrator 172 through the inverting input terminal (−), and a crack reference voltage V0 is applied to the non-inverting input terminal (+). Accordingly, the output signal of the comparator 173 may transit at a moment when the accumulated voltage supplied from the integrator 172 becomes more than the crack reference voltage V0.

The comparison voltage control logic 174 supplies a clock period between a start point of the master mode and a point when the voltage Vpanel of the display panel block becomes more than the crack reference voltage V0 to the counter 176 using a clock signal supplied from the clock generator 175.

The counter 176 counts the number of clocks included in the clock period supplied from the comparison voltage control logic 174 using the clock signal supplied from the clock generator 175 to supply a time when the voltage Vpanel of the display panel block reaches at the crack reference voltage V0 by the crack detection signal PCD_Out.

First, the crack detecting circuit 170 may measure a reference voltage Vref by the reference resistor Rref while the driving voltage Vcc is connected to the reference resistor Rref within a crack detecting period. And then, the crack detecting circuit 170 may measure the voltage Vpanel of the display panel block based on the resistance Rpanel of the display panel block while the driving voltage Vcc is connected to the display panel block.

That is, the crack detecting period may be divided into a first detecting period for measuring the reference voltage Vref based on the reference resistor Rref and a second detecting period for measuring the voltage Vpanel of the display panel block based on the resistance Rpanel of the display panel block.

During the first detecting period, it counts a time when the reference voltage Vref charged in the feedback capacitor Cf reaches of the display panel block reaches at the crack reference voltage V0 by supplying the driving voltage Vcc to the feedback capacitor Cf of the comparator 172 through the reference resistor Rref.

During the second detecting period, it counts a time when the voltage Vpanel of the display panel block charged in the feedback capacitor Cf reaches at the crack reference voltage V0 by connecting the driving voltage Vcc to the reference resistor Rref of the display panel block.

In this way, the crack detecting circuit 170 may supply the time when the reference voltage Vref reaches at the crack reference voltage V0 during the first detecting period, and the time when the voltage Vpanel of the display panel block reaches at the crack reference voltage V0 during the second detecting period to the timing controller 140. Therefore, the timing controller 140 may determine a crack state of the display panel block using them.

In this case, an interface protocol between the timing controller 140 and the data driving circuit 130 may be variously selected or defined. As an example, the display device 100 according to aspects may transfer signals between the timing controller 140 and the data driving circuit 130 using an embedded point-to-point interface (EPI) protocol.

Figure 4:
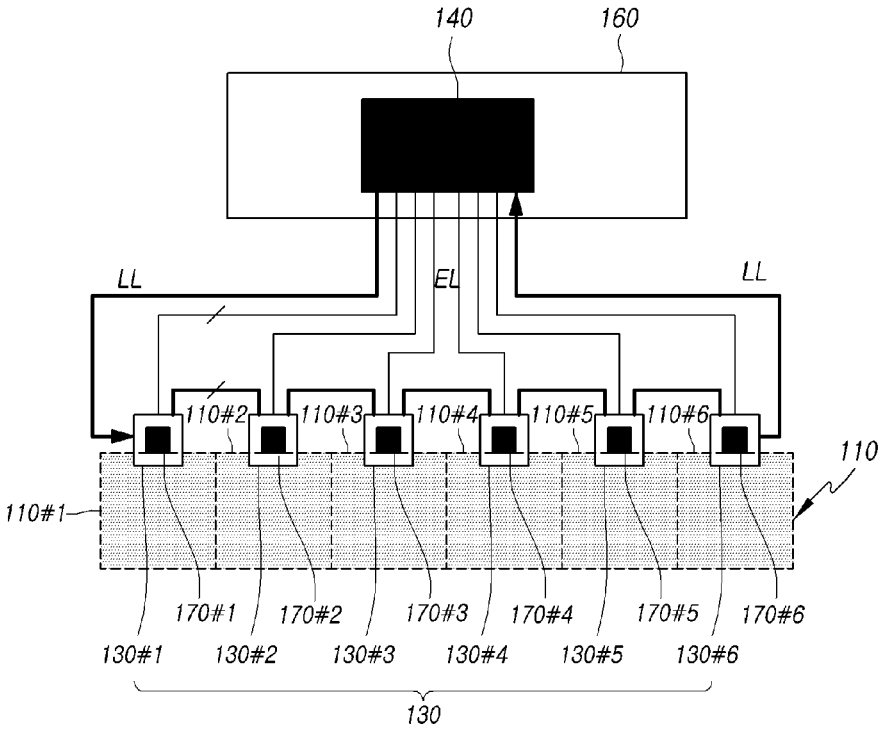
FIG. 4 is a diagram illustrating a structure of controlling a data driving circuit using an EPI protocol in a display device according to aspects.

FIG. 4 is a diagram illustrating a structure of controlling a data driving circuit using an EPI protocol in a display device according to aspects.

Referring to FIG. 4, the data driving circuit 130 using the EPI protocol in the display device 100 according to aspects may directly generate a clock signal based on a data signal received from the timing controller 140. Accordingly, there is no need to have a clock line for transmitting the clock signal between the timing controller 140 and the data driving circuit 130 using the EPI protocol.

The display device 100 may be composed of a plurality of data driving circuits 130. It is illustrated as an example that the display panel 110 is divided into six display panel blocks 110#1-110#6, and a first data driving circuit 130#1 to the sixth data driving circuit 130#6 for driving the display panel blocks 110#1-110#6 constitute the data driving circuit 130. Accordingly, the first crack detecting circuit 170#1 to the sixth crack detecting circuit 170#6 may be disposed inside the first data driving circuit 130#1 to the sixth data driving circuit 130#6.

The first crack detecting circuit 170#1 to the sixth crack detecting circuit 170#6 may detect crack states of the corresponding display panel blocks 110#1-110#6 through the crack detecting line connected to the first display panel block 110#1 to the sixth display panel block 110#6 respectively.

The timing controller 140 supplies a LOCK signal for initializing the data driving circuit 130 to the first data driving circuit 130#1 through a LOCK signal line LL connecting the plurality of data driving circuits 130 in series before supplying the digital image data DATA to the data driving circuit 130. The LOCK signal supplied to the first data driving circuit 130#1 is sequentially transmitted through the second data driving circuit 130#2 to the sixth data driving circuit 130#6 through the LOCK signal line LL. The sixth data driving circuit 130#6 supplies the LOCK signal received through the LOCK signal line LL back to the timing controller 140.

When the LOCK signal is normally received through such a process, the timing controller 140 supplies the digital image data DATA to the data driving circuits 130 through a plurality of EPI lines EL connected 1:1 with the plurality of data driving circuits 130. Each of the data driving circuits 130 converts the received digital image data DATA into a corresponding analog data voltage, and supplies the analog data voltage to the display panel blocks 110#1-110#6 to display an image through the display panel 110.

In the display device 100 according to aspects, the data driving circuit 130 operating as the master mode generates the crack detection signal PCD_Out for a corresponding display panel block, and transmits the crack detection signal PCD_Out through the LOCK signal line LL to detect crack states for the entire display panel blocks or for some designated display panel blocks.

Here, it is illustrated the case of using the embedded point-to-point interface (EPI) protocol as an example, and there are various protocols that can be used for signal transmission between the data driving circuits 130.

Figure 5:
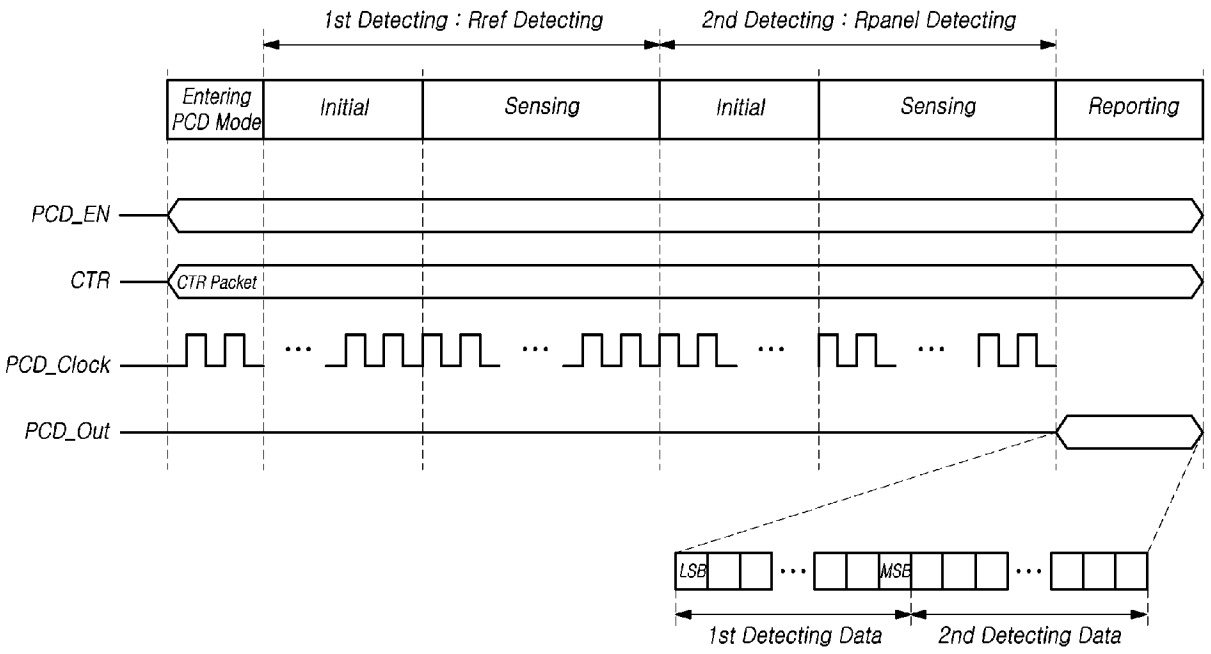
FIG. 5 is a diagram illustrating a signal waveform for detecting a crack of a display panel using an EPI protocol in a display device according to aspects.

FIG. 5 is a diagram illustrating a signal waveform for detecting a crack of a display panel using an EPI protocol in a display device according to aspects. Referring to FIG. 5, the crack detection circuit 170 included in the data driving circuit 130 in the display device 100 according to aspects detects cracks based on the clock signal PCD_Clock within a period when the timing controller 140 supplies a crack detection enable signal PCD_EN.

Accordingly, the corresponding data driving circuit 130 enters into the master mode and detects cracks on the display panel block according to the crack detection enable signal PCD_EN generated by the timing controller 140.

Meanwhile, a crack detection control signal CTR for selecting an operation mode of the data driving circuit 130 as the master mode, the slaver mode, or the reporter mode may be supplied, and the data driving circuit 130 operates in the master mode, the slaver mode, or the reporter mode according to the crack detection control signal CTR.

After entering into the crack detecting mode, the reference voltage Vref based on the reference resistor Rref is measured during the first detecting period (1st Detecting). In this case, an initialization period for initializing the feedback capacitor Cf of the integrator 172 may be processed.

Therefore, all of the first switch S1 to the third switch S3 of the data driving circuit 130 operating as the master mode during the initial period (Initial) in the first detecting period (1st Detecting) are turned off, and the fourth switch S4 of the integrator 172 is turned on to initialize the feedback capacitor Cf.

In the data driving circuit 130 operating as the master mode during the sensing period (Sensing) after the initialization period (Initial), the driving voltage Vcc is connected to the reference resistor Rref by the third switch S3. Also, the first switch S1, the second switch S2, and the fourth switch S4 are turned off, and the voltage transmitted through the reference resistor Rref is charged in the feedback capacitor Cf.

Accordingly, the counter 176 determines the time for the reference voltage Vref charged in the feedback capacitor Cf to reach the crack reference voltage V0 through the comparator 173 and the comparison voltage control logic 174, and stores a first detecting data (1st Detecting Data) in a register.

Meanwhile, an operation for detecting the voltage Vpanel of the display panel block due to the resistance Rpanel of the display panel block is performed in the second detecting period (2nd Detecting).

In the initialization period (Initial) like the initialization period (Initial) of the first detecting period (1st Detecting), the fourth switch S4 of the data driving circuit 130 operating as the master mode is only turned on to initialize the feedback capacitor Cf.

During the sensing period (Sensing) in the second detecting period (2nd Detecting), the driving voltage Vcc is connected to the display panel block by the third switch S3, and the second switch S2 is turned on while the first switch S1 and the fourth switch S4 are turned off, so that the voltage Vpanel of the display panel block is charged in the feedback capacitor Cf.

Accordingly, the counter 176 counts the time while the voltage Vpanel of the display panel block charged in the feedback capacitor Cf through the comparator 173 and the comparison voltage control logic 174 reaches the crack reference voltage V0, and stores the second detecting data (2nd Detecting Data) in a register.

When the first detecting period (1st Detecting) and the second detecting period (2nd Detecting) are finished, the reference voltage Vref and the counting value (1st Detecting Data, 2nd Detecting Data) for the voltage Vpanel of the display panel block stored in the register is supplied to the timing controller 140.

The timing controller 140 may calculate the resistance Rpanel of the display panel block and determine the crack state using the counting values (1st Detecting Data, 2nd Detecting Data) supplied from the crack detecting circuit 170.

Figure 6:
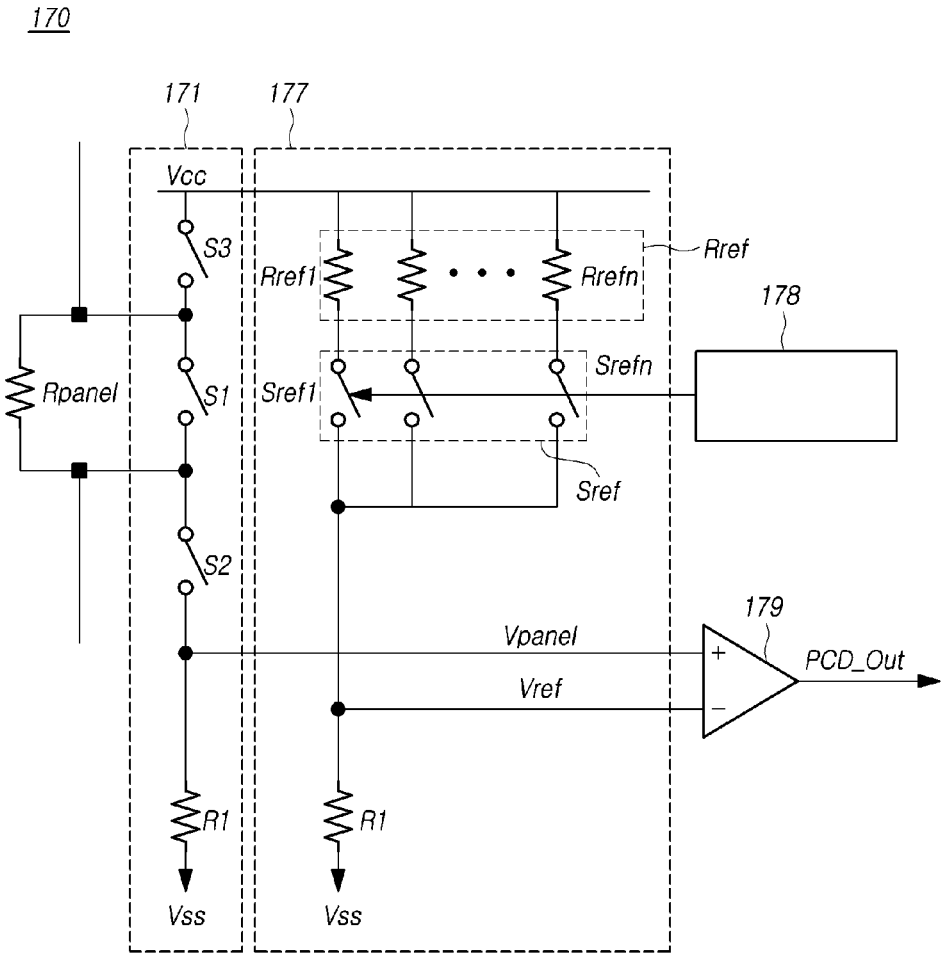
FIG. 6 is a circuit diagram illustrating a crack detecting circuit in a display device according to other aspects.

FIG. 6 is a circuit diagram illustrating a crack detecting circuit in a display device according to other aspects. Referring to FIG. 6, the crack detecting circuit 170 according to other aspects may include a mode selector 171, a reference voltage setter 177, a reference voltage control logic 178, and a crack ruler 179.

The mode selector 171 may include a plurality of switches S1, S2, S3 connected in series between the driving voltage Vcc and the base voltage Vss, and a base resistor R1. The plurality of switches S1, S2, S3 may be changed states of ON or OFF according to the master mode, the slaver mode, and the reporter mode of the data driving circuit 130, and both ends of the first switch S1 are connected to the display panel block through a crack detecting line to measure the voltage Vpanel of the display panel block.

The resistance Rpanel of the display panel block may be determined by comparing the voltage Vpanel of the display panel block with the reference voltage Vref, and it is possible to determine the crack state of the display panel block using the resistance Rpanel of the display panel block.

In the case of the master mode in which the resistance Rpanel of the display panel block can be determined, the third switch S3 adjacent to the driving voltage Vcc and the second switch S2 adjacent to the base resistor R1 are turned on, and the first switch S1 connected to both ends of the display panel block is turned off. Accordingly, the voltage Vpanel of the display panel block may be transmitted to the crack ruler 179 by distribution of the resistance Rpanel of the display panel block and the base resistor R1.

Meanwhile, in the case of the slaver mode, the first switch S1 connected to both ends of the display panel block is turned on, and the third switch S3 connected to the driving voltage Vcc and the second switch S2 connected to the base resistor R1 are turned off.

At this time, both ends of the first switch S1 are respectively connected to the adjacent data driving circuit 130 at the previous stage and the adjacent data driving circuit 130 at the next stage. Therefore, when the first switch S1 is turned on, the crack detection signal PCD_Out supplied from the data driving circuit 130 at the previous stage is bypassed to the data driving circuit 130 at the next stage.

In the reporter mode, all of the first switch S1, the second switch S2, and the third switch S3 constituting the mode selector 171 are turned off. Accordingly, the crack detection signal PCD_Out supplied from the data driving circuit 130 at the previous stage is not transmitted to the data driving circuit 130 at the next stage.

The base voltage Vss may be a ground voltage.

The reference voltage setter 177 is a part that generates a reference voltage Vref for comparison with the voltage Vpanel of the display panel block supplied from the mode selector 171.

The reference voltage setter 177 may include a reference resistor group Rref consisting of n reference resistors Rref1-Rrefn connected in parallel to the driving voltage Vcc, a reference switch group Sref consisting of n reference switches Sref1-Srefn connected individually to each reference resistor Rref1-Rrefn, and a base resistor R1 connected between the reference switch group Sref and the base voltage Vss.

The reference resistor group Rref may be composed of n reference resistors Rref1-Rrefn with a different resistance value respectively, and may consist of reference resistors Rref1-Rrefn with various resistance values so that it can classify the states of the display panel block, including a normal state, a crack state, or a disconnection state.

The reference switch group Sref selects one reference resistor connected to the base resistor R1 from among n reference resistors Rref1-Rrefn by the reference voltage control logic 178. In this case, the reference switch group Sref sequentially turns on the n-th reference switch Srefn from the first reference switch Sref1, so that the reference voltage Vref for comparison with the voltage Vpanel of the display panel block supplied from the mode selector 171 may be sequentially changed.

In the case of the master mode, the crack ruler 179 compares the voltage Vpanel of the display panel block supplied from the mode selector 171 with the reference voltage Vref, and generates the crack detection signal PCD_Out. The crack ruler 179 may be configured with a comparator made of an operational amplifier.

At this time, the crack detection signal PCD_Out supplied from the crack ruler 179 may be made of an n-bit digital signal representing a comparison result of the voltage Vpanel of the display panel block and the reference voltage Vref by n reference switches Sref1-Srefn that are sequentially turned on by the reference voltage control logic 178.

Figure 7:
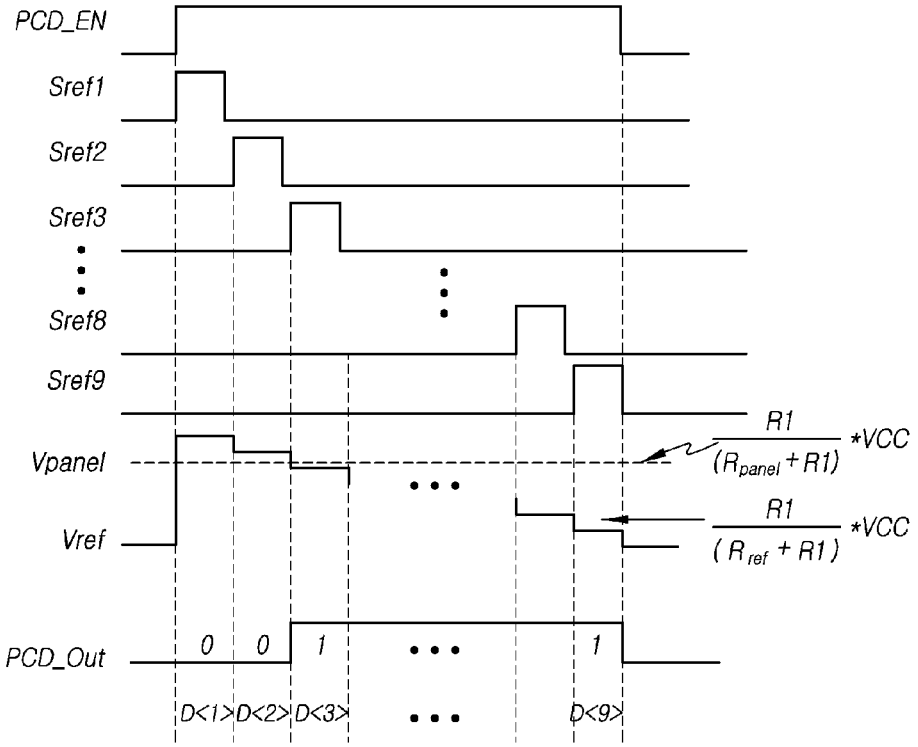
FIG. 7 is a diagram illustrating a signal waveform for the crack detecting circuit of FIG. 6 in a display device according to other aspects.

FIG. 7 is a diagram illustrating a signal waveform for the crack detecting circuit of FIG. 6, and FIG. 8 is a diagram illustrating a crack detection signal generated by the signal waveform of FIG. 7 in a display device according to other aspects.

Referring to FIG. 7 and FIG. 8, a specific data driving circuit 130 of the display device 100 according to aspects may operate as a master mode under the control of the timing controller 140.

At this time, the data driving circuit 130 operating as the master mode may sequentially turn on the n reference switches Sref1-Srefn connected to n reference resistors Rref1-Rrefn during the period in which the crack detecting enable signal PCD_EN is applied to determine the voltage Vpanel of the corresponding display panel block. Here, it illustrates as a sample the case where 9 reference resistors Rref1-Rref9 are connected to 9 reference switches Sref1-Sref9.

The crack detecting circuit 170 may supply a comparison result (0 or 1) with a crack detection signal PCD_Out by sequentially comparing a voltage Vpanel of the display panel block connected to the data driving circuit 130 with a reference voltage Vref during a period in which the 9 reference switches Sref1-Sref9 are sequentially turned on.

At this time, the reference voltage Vref is sequentially changed by 9 reference resistors Rref1-Rref9. Here, it illustrates as a sample the case in which the reference voltage Vref is changed sequentially from the highest value to the lowest value.

For example, the crack detection signal PCD_Out may have 0 value when the voltage Vpanel of the display panel block is less than the reference voltage Vref, and the crack detection signal PCD_Out may have 1 value when the voltage Vpanel of the display panel block is more than the reference voltage Vref.

Accordingly, it is possible to determine the resistance Rpanel of the display panel block based on the n-bit crack detection signal PCD_Out.

FIG. 8 illustrates an example of determining the resistance Rpanel of a display panel block using a 9-bit crack detection signal PCD_Out. For example, when a 9-bit crack detection signal PCD_Out consisting of nine is is generated in case that the voltage Vpanel of the display panel block is more than the 9 reference voltages Vref as a result of determining the resistance Rpanel of the display panel block while sequentially changing 9 reference resistors Rref1-Rref9, it may determine that the resistance Rpanel of the corresponding display panel block is less than 3K, and thus as a normal connection state without cracks.

Alternatively, as in the case of FIG. 7, when the voltage Vpanel of the display panel block is less than the first reference voltage Vref1 and the second reference voltage Vref2, and is more than from the third reference voltage Vref3 to the ninth reference voltage Vref9, a crack detection signal PCD_Out of 001111111 is generated. In this case, the resistance Rpanel of the display panel block may be determined to be a value between 5K and 7K.

On the other hand, when the voltage Vpanel of the display panel block is less than all 9 reference voltages Vref and a crack detection signal PCD_Out of 000000000 is generated, it may be determined that the resistance Rpanel of the corresponding display panel block is very big over 19K or disconnected.

As described above, when the resistance Rpanel of the display panel block is determined using the 9-bit crack detection signal PCD_Out, the resistance Rpanel of the display panel block may be classified into nine types.

In this case, the crack state of the display panel block may be classified in detail using an n-bit crack detection signal PCD_Out.

For example, it may be determined as a normal state if the number of 0s is 2 or less among n-bit crack detection signal PCD_Out, as a fine crack if the number of 0s is 3 to 5, as a dangerous crack if the number of 0s is 6 to 8, and as a disconnection if the number of 0s is 9 or more. These detailed crack states may be variously changed according to the type and structure of the display panel 110 and the value of the reference voltage Vref.

In this case, the data driving circuit 130 may include a register, and the crack detection signal PCD_Out generated by the crack detecting circuit 170 is stored in the register, and then is supplied to the timing controller 140.

Meanwhile, it is necessary to determine an interface protocol for delivering a signal between the timing controller 140 and the data driving circuit 130 to determine the crack state of the display panel block by controlling the modes of the plurality of data driving circuits 130 from the timing controller 140.

Figure 9:
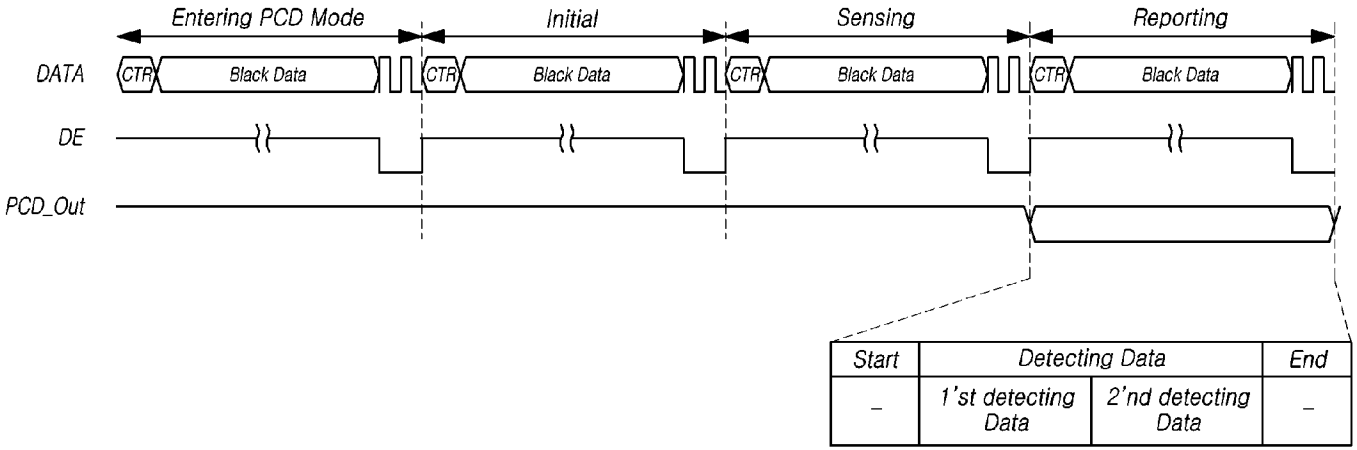
FIG. 9 is a diagram illustrating a signal waveform for detecting a crack of a display panel using an EPI protocol in a display device according to other aspects.

FIG. 9 is a diagram illustrating a signal waveform for detecting a crack of a display panel using an EPI protocol in a display device according to other aspects.

Referring to FIG. 9, the display device 100 according to aspects may detect a crack state of the display panel in a crack detecting mode (PCD Mode), and supply the crack detection signal PCD_Out to the timing controller 140.

The crack detecting mode (PCD Mode) may be exemplarily divided into an entering period of the crack detecting mode (Entering PCD Mode), an initialization period (Initial), a sensing period (Sensing), and a reporting period (Reporting).

Each period (Entering PCD Mode, Initial, Sensing, Reporting) may use a crack detection control signal CTR for selecting an operation mode of the data driving circuit 130 in order to detect cracks of all or part of the display panel blocks.

Meanwhile, the timing controller 140 does not supply digital image data DATA but supply black data (Black Data) to the data driving circuit 130 during a period in which the crack detecting circuit 170 operates as the crack detecting mode (PCD Mode).

In the initialization period (Initial), switches S1, S2, S3 for the crack detecting circuit 170 in the data driving circuit 130 may be controlled according to an operation mode (master mode, slaver mode, or reporter mode) in order to detect cracks of the display panel block.

In the sensing period (Sensing), the crack detecting circuit 170 may detect a crack state of a display panel block operating as a master mode, and store the crack detection signal PCD_Out in the internal register. In this case, the value of the reference resistor Rref constituting the crack detecting circuit 170 may also be detected during the sensing period (Sensing).

In the reporting period (Reporting), the crack detection signal PCD_Out stored in the register may be supplied to the timing controller 140 through the LOCK signal line LL.

In this case, the crack detection signal PCD_Out supplied to the timing controller 140 in the reporting period (Reporting) indicates a result of detecting cracks of the display panel block in which crack detection has been performed.

Using such EPI protocol, the display device 100 according to aspects may detect cracks of the all or part of display panel blocks by operation of the data driving circuit 130 as the master mode, the slaver mode, or the reporter mode.

Figure 10:
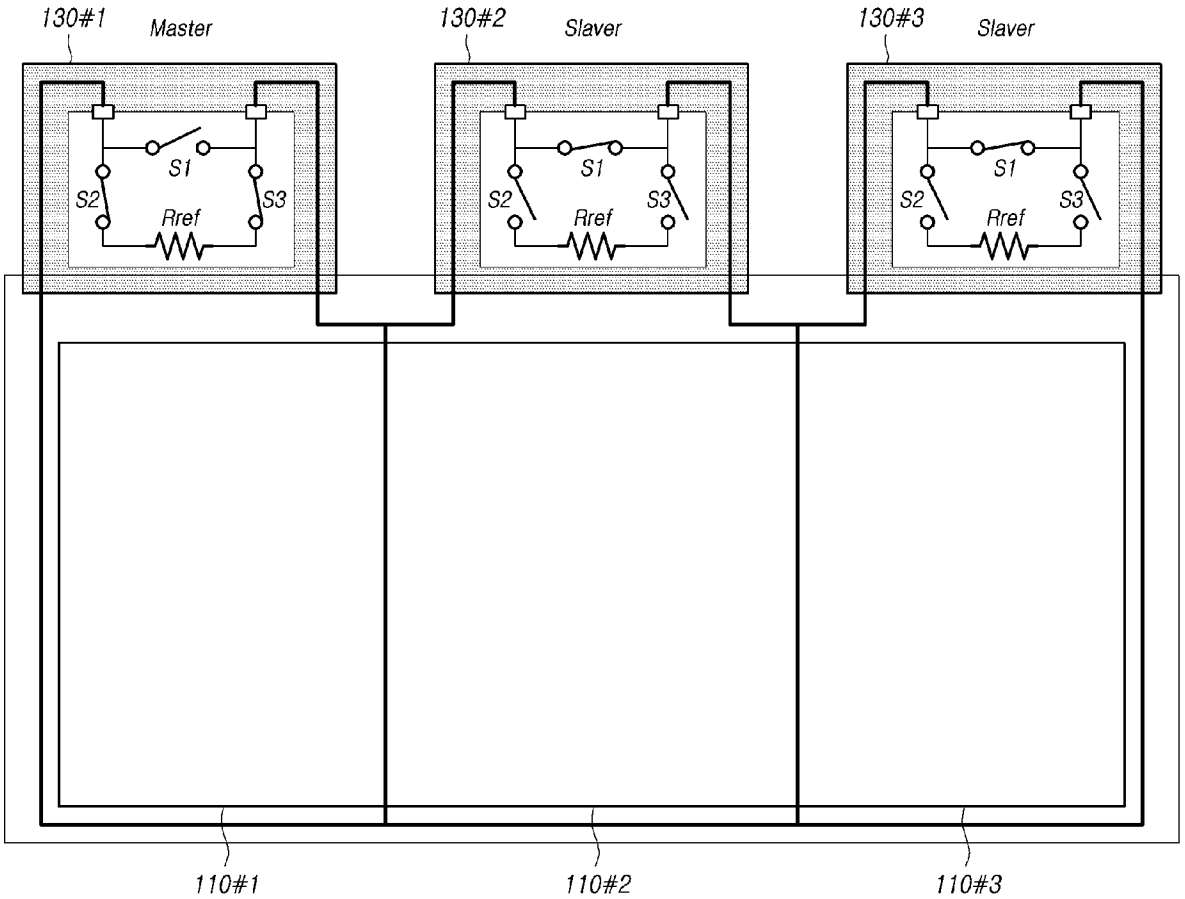
FIG. 10 is a diagram illustrating an operation mode for detecting a crack at entire portion of a display panel in a display device according to other aspects.

FIG. 10 is a diagram illustrating an operation mode for detecting a crack at entire portion of a display panel in a display device according to other aspects. The display device 100 may include a plurality of data driving circuits 130. For convenience of description, it is illustrates as an example that the display panel 110 is divided into three display panel blocks 110#1-110#3 and the data driving circuit 130 is composed of the first data driving circuit 130#1 to the third data driving circuit 130#3 for driving each display panel block 110#1-110#3.

Referring to FIG. 10, the display device 100 according to aspects may detect cracks of the entire display panel 110 by controlling the first data driving circuit 130#1 of the plurality of data driving circuits 130 to operate as the master mode, and controlling the second data driving circuit 130#2 and the third data driving circuit 130#2 to operate as the slaver mode.

As described above, for the first data driving circuit 130#1 operating as the master mode, the third switch S3 adjacent to the driving voltage Vcc and the second switch S2 adjacent to the base resistor R1 are turned on, and the first switch S1 connected to the first display panel block 110#1 at both ends is turned off in the mode selector 171 constituting the crack detecting circuit 170#1. Accordingly, a crack detection signal PCD_Out corresponding to a result of comparing the voltage Vpanel of the first display panel block 110#1 and the reference voltage Vref is generated.

At this time, for the second data driving circuit 130#2 and the third data driving circuit 130#2 operating as the slaver mode, the first switch S1 connecting the display panel blocks 110#2, 110#3 is turned on, and the third switch S3 connected to the driving voltage Vcc and the second switch S2 connected to the base resistor R1 are turned off in the mode selector 171 constituting the crack detecting circuits 170#2, 170#3. Accordingly, the crack detection signal PCD_Out supplied from the first data driving circuit 130#1 operating as the master mode is bypassed.

That is, the second data driving circuit 130#2 and the third data driving circuit 130#2 operating as the slaver mode does not detect cracks of the second display panel block 110#2 and the third display panel block 110#3, but performs an operation of bypassing the crack detection signal PCD_Out from the first data driving circuit 130#1 operating as the master mode.

Accordingly, when the first data driving circuit 130#1 operates as the master mode, and the second data driving circuit 130#2 and the third data driving circuit 130#2 operate as the slaver mode, crack detection is performed for the first display panel block 110#1 and the crack detection signal PCD_Out is bypassed for the second display panel block 110#2 and the third display panel block 110#3. Therefore, it is possible to check also whether the first display panel block 110#1, the second display panel block 110#2, or the third display panel block 110#3 is disconnected.

The crack detection signal PCD_Out may be stored in the register and supplied to the timing controller 140 during the reporting period (Reporting).

Figure 11:
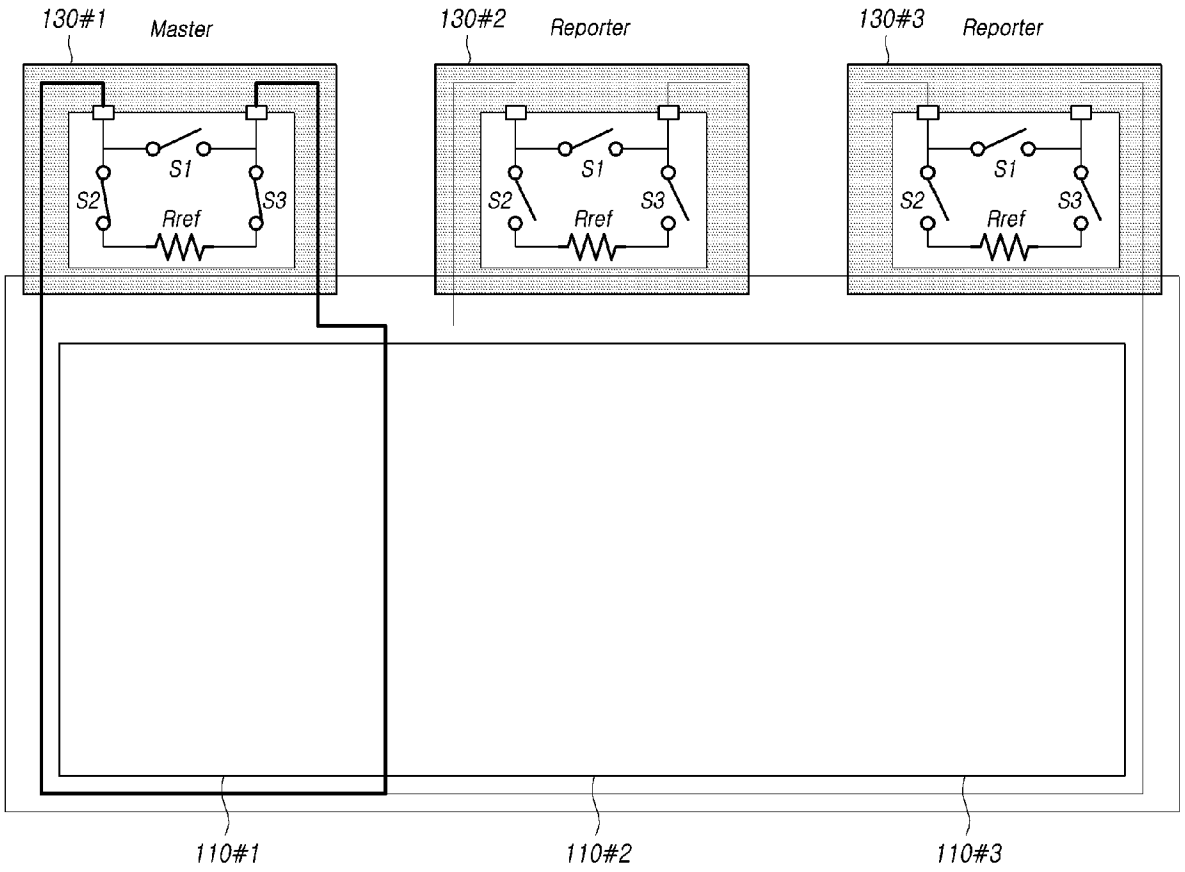
FIG. 11 is a diagram illustrating an operation mode for detecting a crack at a first display panel block in a display device according to other aspects.

FIG. 11 is a diagram illustrating an operation mode for detecting a crack at a first display panel block in a display device according to other aspects.

Referring to FIG. 11, the display device 100 according to aspects may control the first data driving circuit 130#1 among the plurality of data driving circuits 130 to operate as the master mode, and the second data driving circuit 130#2 and the third data driving circuit 130#3 among the plurality of data driving circuits 130 to operate as the reporter mode. Accordingly, it is possible to detect crack of the first display panel block 110#1 among the plurality of display panel blocks 110#1-110#3.

Similarly, for the first data driving circuit 130#1 operating as the master mode, the third switch S3 adjacent to the driving voltage Vcc and the second switch S2 adjacent to the base resistor R1 are turned on, and the first switch S1 connected to the first display panel block 110#1 at both ends is turned off in the mode selector 171 constituting the crack detecting circuit 170#1. Accordingly, a crack detection signal PCD_Out corresponding to a result of comparing the voltage Vpanel of the first display panel block 110#1 and the reference voltage Vref is generated.

At this time, for the second data driving circuit 130#2 and the third data driving circuit 130#3 operating as the reporter mode, all the first switch S1, the second switch S2 and the third switch S3 are turned off in the mode selector 171 constituting the crack detecting circuits 170#2, 170#3. Accordingly, the crack detection signal PCD_Out generated in the first data driving circuit 130#1 does not transmitted through the second data driving circuit 130#2 and the third data driving circuit 130#3.

Accordingly, when the first data driving circuit 130#1 operates as the master mode, and the second data driving circuit 130#2 and the third data driving circuit 130#2 operate as the reporter mode, crack detection signal PCD_Out generated in the first display panel block 110#1 is stored in the register of the first data driving circuit 130#1 and crack detection does not performed for the second display panel block 110#2 and the third display panel block 110#3.

Thereafter, the crack detection signal PCD_Out stored in the register of the first data driving circuit 130#1 is supplied to the timing controller 140 in the reporting period (Reporting), so that the timing controller 140 may check the crack state of the first display panel block 110#1.

Figure 12A:
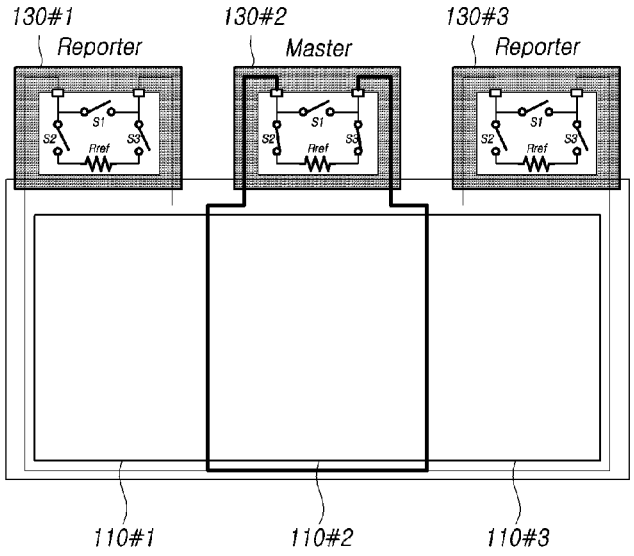
FIG. 12A and FIG. 12B are diagrams illustrating an operation mode for detecting cracks at a second display panel and a third display panel in a display device according to other aspects.
Figure 12B:
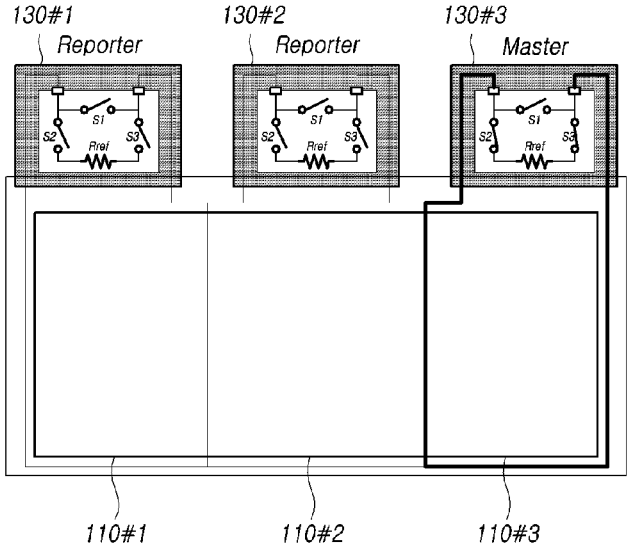

FIG. 12A and FIG. 12B are diagrams illustrating an operation mode for detecting cracks at a second display panel and a third display panel in a display device according to other aspects.

Referring to FIG. 12A, the display device 100 according to aspects may control the second data driving circuit 130#2 among the plurality of data driving circuits 130 to operate as the master mode, and control the first data driving circuit 130#1 and the third data driving circuit 130#3 among the plurality of data driving circuits 130 to operate as the reporter mode. Accordingly, it is possible to detect crack of the second display panel 110#2 among the plurality of display panel blocks 110#1-110#3.

Referring to FIG. 12B, the display device 100 according to aspects may control the third data driving circuit 130#3 among the plurality of data driving circuits 130 to operate as the master mode, and control the first data driving circuit 130#1 and the second data driving circuit 130#2 among the plurality of data driving circuits 130 to operate as the reporter mode. Accordingly, it is possible to detect crack of the third display panel block 110#3 among the plurality of display panel blocks 110#1-110#3.

Similarly, for the data driving circuit (130#2 or 130#3) operating as the master mode, the third switch S3 adjacent to the driving voltage Vcc and the second switch S2 adjacent to the base resistor R1 are turned on, and the first switch S1 connected to the display panel block (110#1 or 110#3) at both ends is turned off in the mode selector 171 constituting the crack detecting circuit (170#2 or 170#3). Accordingly, a crack detection signal PCD_Out may be generated which corresponds to a result of comparing the voltage Vpanel of the second display panel block 110#2 or the third display panel block 110#3, and the reference voltage Vref.

Also, for the data driving circuit (130#1, 130#3 or 130#1, 130#2) operating as the reporter mode, all the first switch S1, the second switch S2 and the third switch S3 are turned off in the mode selector 171 constituting the crack detecting circuit 170. Accordingly, the crack detection signal PCD_Out generated in the data driving circuit (130#2 or 130#3) operating as the master mode does not supplied to the data driving circuit (130#1, 130#3 or 130#1, 130#2) operating as the reporter mode.

Thereafter, the crack detection signal PCD_Out stored in the register of the data driving circuit (130#2 or 130#3) operating as the master mode is supplied to the timing controller 140 in the reporting period (Reporting), so that the timing controller 140 may check the crack state of the second display panel block 110#2 or the third display panel block 110#3.

As described above, the display device 100 according to aspects divides the display panel 110 into a plurality of display panel blocks, and independently controls the data driving circuit 130 connected to each display panel block according to selected mode. Accordingly, the display device 100 may detect cracks for each display panel block.

In particular, the display device 100 according to aspects may sequentially compare the voltage Vpanel of the display panel block and the reference voltage Vref using a plurality of reference resistors Rref formed in the crack detecting circuit 170. Accordingly, the display device 100 may detect not only fine cracks but also disconnection.

The above description has been presented to enable any person skilled in the art to make and use the technical idea of the present disclosure, and has been provided in the context of a particular application and its requirements. Various modifications, additions and substitutions to the described aspects will be readily apparent to those skilled in the art, and the general principles defined herein may be applied to other aspects and applications without departing from the spirit and scope of the present disclosure. The above description and the accompanying drawings provide an example of the technical idea of the present disclosure for illustrative purposes only. That is, the disclosed aspects are intended to illustrate the scope of the technical idea of the present disclosure. Thus, the scope of the present disclosure is not limited to the aspects shown, but is to be accorded the widest scope consistent with the claims. The scope of protection of the present disclosure should be construed based on the following claims, and all technical ideas within the scope of equivalents thereof should be construed as being included within the scope of the present disclosure.

What is claimed is:

1. A display device comprising:

a display panel in which a plurality of data lines and a plurality of subpixels are arranged and divided into a plurality of display panel blocks;

a plurality of data driving circuits including a plurality of crack detecting circuits and supplying data voltages to the plurality of display panels through the plurality of data lines; and a timing controller controlling the plurality of data driving circuits;

wherein the plurality of crack detecting circuits generate a crack detection signal for at least a part of the plurality of display panel blocks according to an operation mode of the plurality of the data driving circuits;

wherein the operation mode includes:

a master mode for detecting a state of a display panel block by the plurality of crack detecting circuits;

a slaver mode for bypassing the crack detection signal supplied from the plurality of data driving circuits operating as the master mode; and a reporter mode for disconnecting an electrical connection between the display panel block and the plurality of data driving circuits.

2. The display device according to claim 1, wherein the crack detecting circuit includes:

a mode selector for selecting the operation mode of the data driving circuit;

an integrator for accumulating an output signal of the mode selector;

a comparator for comparing an output signal of the integrator with a crack reference voltage;

a clock generator for generating a clock signal;

a comparison voltage control logic for determining a clock period between a start point of a master mode and a point when a voltage of the display panel block becomes more than the crack reference voltage by using the clock signal supplied from the clock generator; and a counter for generating the crack detection signal by counting a number of the clocks included in the clock period supplied from the comparison voltage control logic using the clock signal supplied from the clock generator.

3. The display device according to claim 2, wherein the mode selector includes:

a plurality of switches connected in series to a driving voltage; and a plurality of reference resistors connected in parallel to the plurality of switches.

4. The display device according to claim 2, wherein the integrator includes:

an amplifier in which the output signal of the mode selector is applied to an inverting input terminal and a base voltage is applied to a non-inverting input terminal; and a feedback switch and a feedback capacitor connected in parallel between the inverting input terminal and an output terminal of the amplifier.

5. The display device according to claim 2, wherein the comparator includes an amplifier in which an accumulated voltage supplied from the integrator is applied to an inverting input terminal, and the crack reference voltage is applied to the non-inverting input terminal.

6. The display device according to claim 2, wherein the crack detection signal includes:

a first detecting data corresponding to a time for a reference voltage transmitted through the reference resistor reaching the crack reference voltage; and a second detecting data corresponding to a time for a voltage of the display panel block reaching the crack reference voltage.

7. The display device according to claim 1, wherein the crack detecting circuit includes:

a mode selector for selecting the operation mode of the data driving circuit;

a reference voltage setter for generating a reference voltage;

a reference voltage control logic for controlling the reference voltage setter; and a crack ruler for generating the crack detection signal by comparing a voltage of the display panel block with the reference voltage.

8. The display device according to claim 7, wherein the mode selector includes a plurality of switches and resistors connected in series between a driving voltage and a base voltage.

9. The display device according to claim 7, wherein the reference voltage setter includes:

a reference resistor group comprising a plurality of reference resistors connected in parallel to a driving voltage;

a reference switch group comprising a plurality of reference switches connected individually to the plurality of reference resistors; and a base resistor connected between the reference switch group and a base voltage.

10. The display device according to claim 7, wherein the crack ruler includes a comparator which compares a voltage of the display panel block supplied from the mode selector with the reference voltage.

11. The display device according to claim 7, wherein the crack detection signal is comprised of n-bit digital signal generated from a comparison result of a voltage of the display panel block and a plurality of different reference voltages sequentially selected by the reference voltage setter.

12. The display device according to claim 11, wherein states of the plurality of display panel blocks are classified with a normal state, a crack state, or a disconnection state.

13. The display device according to claim 1, wherein, in detecting states of the entire display panel blocks, one data driving circuit among the plurality of data driving circuits is operated as the master mode, and other data driving circuits are operated as the slaver mode.

14. The display device according to claim 1, wherein, in detecting states of part of the display panel blocks, one data driving circuit among the plurality of data driving circuits is operated as the master mode, and other data driving circuits are operated as the reporter mode.

15. The display device according to claim 1, further comprising:

a first signal line serially connecting the timing controller and the plurality of data driving circuits to transmit a LOCK signal for initializing the plurality of data driving circuits and the crack detection signal; and a plurality of second signal lines transmitting digital image data by connecting the timing controller to the plurality of data driving circuits with 1:1.

16. The display device according to claim 15, wherein the crack detection signal is supplied to the timing controller through the LOCK signal line during a reporting period.

17. A driving circuit of a display device supplying data voltage to a display panel in which a plurality of subpixels are arranged and divided into a plurality of display panel blocks, comprising:

a plurality of data driving circuits individually supplying the data voltage to each of the plurality of display panel blocks, wherein each of the plurality of data driving circuits include a crack detecting circuit for detecting states of at least a part of the plurality of the display panel blocks according to an operation mode;

wherein the operation mode includes:

a master mode for detecting a state of a display panel block by the crack detecting circuit;

a slaver mode for bypassing the crack detection signal supplied from the data driving circuit operating as the master mode; and a reporter mode for disconnecting an electrical connection between the display panel block and the data driving circuit.

18. The driving circuit according to claim 17, wherein the crack detecting circuit includes:

a mode selector for selecting the operation mode of the data driving circuit;

an integrator for accumulating an output signal of the mode selector;

a comparator for comparing an output signal of the integrator with a crack reference voltage;

a clock generator for generating a clock signal;

a comparison voltage control logic for determining a clock period between a start point of a master mode and a point when a voltage of the display panel block becomes more than the crack reference voltage by using the clock signal supplied from the clock generator; and a counter for generating the crack detection signal by counting a number of the clocks included in the clock period supplied from the comparison voltage control logic using the clock signal supplied from the clock generator.

19. The driving circuit according to claim 17, wherein the crack detecting circuit includes:

a mode selector for selecting the operation mode of the data driving circuit;

a reference voltage setter for generating a reference voltage;

a reference voltage control logic for controlling the reference voltage setter; and a crack ruler for generating the crack detection signal by comparing a voltage of the display panel block with the reference voltage.

* * * * *